US010851558B2

(12) United States Patent
Bruneel

(10) Patent No.: US 10,851,558 B2
(45) Date of Patent: Dec. 1, 2020

(54) AUTONOMOUS ALTERNATING-SUCTION ROBOT FOR CLEANING SWIMMING POOLS

(71) Applicant: KOKIDO DEVELOPMENT LIMITED, Kowloon (HK)

(72) Inventor: Jean Bruneel, Kowloon (HK)

(73) Assignee: KOKIDO DEVELOPMENT LIMITED, Hong Kong (CN)

( * ) Notice: Subject to any disclaimer, the term of this patent is extended or adjusted under 35 U.S.C. 154(b) by 0 days.

(21) Appl. No.: 16/824,855

(22) Filed: Mar. 20, 2020

(65) Prior Publication Data

US 2020/0299987 A1 Sep. 24, 2020

(30) Foreign Application Priority Data

Mar. 22, 2019 (EP) ..... 19305355

(51) Int. Cl.
*E04H 4/16* (2006.01)

(52) U.S. Cl.
CPC ..... *E04H 4/1663* (2013.01); *E04H 4/1654* (2013.01)

(58) Field of Classification Search
CPC ..... E04H 4/1654; E04H 4/1663
See application file for complete search history.

(56) References Cited

U.S. PATENT DOCUMENTS

| | | | | |
|---|---|---|---|---|
| 5,337,434 | A | 8/1994 | Erlich | |
| 5,351,355 | A * | 10/1994 | Chiniara | E04H 4/1654 15/1.7 |
| 10,370,865 | B2 * | 8/2019 | Roumagnac | B63H 11/04 |
| 2002/0104790 | A1 | 8/2002 | Lincke | |

FOREIGN PATENT DOCUMENTS

| | | |
|---|---|---|
| EP | 2821564 | 1/2015 |
| EP | 3283711 | 2/2018 |
| FR | 2869058 | 10/2005 |

OTHER PUBLICATIONS

European Search Report issued in European Patent Application No. 19305355.0 dated Oct. 25, 2019.

* cited by examiner

*Primary Examiner* — Randall E Chin
(74) *Attorney, Agent, or Firm* — Perman & Green, LLP

(57) ABSTRACT

Robot for cleaning swimming pools, including a debris-collection body, a propulsion and suction system able to move the robot in alternation in two substantially opposite directions $D_1$ and $D_2$, and an electrical supply device, the body includes two compartments separated by a partition and each provided with a water inlet. Depending on the direction of movement of the robot, the suction is effected in one compartment and blocked in the other. The suction can be alternated by means of a pivoting suction orifice rotated by a turret.

10 Claims, 5 Drawing Sheets

AUTONOMOUS ALTERNATING-SUCTION ROBOT FOR CLEANING SWIMMING POOLS

CROSS-REFERENCE TO RELATED APPLICATION

This application claims priority to and the benefit of European Application No. EP 19305355.0, filed on 22 Mar. 2019, the disclosure of which is incorporated herein by reference in its entirety.

BACKGROUND

1. Field

The present disclosure belongs to the field of devices for maintaining swimming pools, in particular robots for cleaning swimming pools, and relates more particularly to an autonomous suction robot with alternating suction for cleaning swimming pools.

2. Brief Description of Related Developments

To clean swimming pools and other similar artificial pools, the use of cleaning robots is known, commonly referred to as swimming-pool robots, the main function of which is to suck up debris. There exist various types of swimming pool robot, including electric robots.

Many electric robots are described in the prior art. These robots have undergone several technological changes and in particular with regard to the mobility thereof, and more particularly the automatic orientation thereof for a complete sweep of the surface of the pool bottom. For example, some robots are bidirectional with the two directions of movement substantially offset so as to effectively cover the whole of the surface of the pool without making a return journey in the same direction.

The European patent EP 3283711 B1, in the name of the applicant, discloses a swimming-pool cleaning robot comprising a unit consisting of propulsion motor and electro-hydraulic water-jet pump, and a debris-recovery body that comprises a battery supplying said unit, the unit and the battery being contained in a watertight rotary turret, external to the body of the robot. The robot advantageously comprises an automatic direction-reversal device comprising a blade secured to the turret.

This bidirectional robot moves in alternation in two substantially opposite directions, propelled by the reaction of a water jet issuing from a rotary nozzle, secured to the turret, suitable for adopting two opposite angular positions.

For this robot, and more generally for all the known robots, the suction takes place independently of the direction of movement of the robot. The majority of robots have a main suction orifice through which the water enters the debris-recovery body of the robot, whatever the movement of the latter.

Some robots are provided with a plurality of suction orifices, for example two orifices, one of which is situated in the vicinity of the front side of the robot and the other at the rear of the robot, for a repeated passage over the debris zone, in other words for successive suctions, with a view to refining the cleaning and collection of the debris. Nevertheless, the suction power obtained with a plurality of orifices remains equivalent to that which would be obtained with a single orifice with a cross section equal to the sum of the cross sections of said orifices. In addition, when the suction power does not suffice to "lift" the heaviest debris as soon as the first suction orifice passes, the passage of the second orifice remains just as ineffective, or scarcely more effective.

Because of this, the two suction orifices, as depicted in FIG. 5 showing the prior art schematically, do not have the same usefulness according to the direction of movement of the robot. This is because the suction orifice that is situated at the front in the direction of movement of the robot sucks up a major part of the debris, and the other orifice, at the rear, sucks up only some debris that has remained on the bottom. Thus the efficacy of a robot with two suction orifices that are symmetrical with respect to a midplane of said robot is very slightly superior to that of a robot having a single suction orifice with an equivalent cross section.

Given the importance of the location of the suction orifice, which must be situated in the vicinity of the front edge of the robot in order to recover the debris without its being dispersed by the forward travel of the robot and in order to capture the debris at the edge of the bottom of the pool, it is not judicious to use a single orifice that would be off-centre with respect to the robot.

For bidirectional swimming-pool robots with two suction orifices, no solution of the prior art makes it possible to automatically concentrate the whole of the suction on a single suction orifice that is the most effective according to the direction of movement of the robot.

In summary, swimming-pool robots are equipped with one or more suction pumps and may have one or two suction orifices. A single orifice, generally situated on the axis of the robot, does not make it possible to effectively capture the debris in the vicinity of the peripheral walls for example. The solution that consists of creating an orifice at each end of the robot would make it possible to solve this problem, but the simultaneous functioning of these two orifices results in a lower suction rate at each orifice, and therefore in a loss of efficacy. Preserving the efficacy of two orifices actuated simultaneously would involve a doubling of the suction power of the pump, which would increase the costs thereof, would double the energy consumption, and would be detrimental to the range of a battery-powered robot.

The solution proposed makes it possible to resolve these problems without increasing power and without loss of efficacy by producing a robot with two end orifices with alternating functioning so as to have available on the active orifice the whole of the flow aspirated by the pump.

SUMMARY

The main aim of the present disclosure is to overcome the limitations of the prior art by proposing a swimming-pool robot with alternating suction, said suction taking place through only one orifice at a time according to the direction of movement of said robot, thus improving the efficacy of the suction and/or reducing the energy consumption of the robot.

To this end, the present disclosure relates to a robot for cleaning swimming pools comprising a debris-collection body, a propulsion and suction system able to move the robot in alternation in two substantially opposite directions, and a power supply device, such as a supply battery. This robot is remarkable in that the body comprises two filtering compartments separated by a partition and each provided with a water inlet, said partition making it possible to concentrate the total suction of the robot in one compartment and to block it in the other according to the direction of movement of the robot.

According to one advantageous aspect of the disclosure, the propulsion and suction system and the power supply device are contained in a watertight rotary turret, external to the body of the robot, and each direction of movement of the robot is determined by an automatic orientation of the turret.

According to another aspect of the disclosure, the propulsion and suction system comprises two motorised propellers, each of said propellers providing the propulsion of the robot in one of the directions of movement and the suction in one of the filtering compartments.

Advantageously, the robot comprises a pivoting suction orifice integral with the turret, said orifice allowing passage of the water in one compartment and blocking the passage of the water in the other compartment, so as to concentrate the total suction of the robot in one compartment or the other according to the direction of movement of the robot.

More particularly, the pivoting suction orifice comprises a lateral opening communicating with one compartment at a time, and a top opening communicating with a water outlet of the robot.

For example, the pivoting suction orifice is in the form of a hollow cylinder with a circular base, the lateral opening being produced on a diameter of said cylinder and the top opening being axial and contiguous with said lateral opening. Advantageously, the pivoting suction orifice is disposed above the partition so as to fit flush with the top edge of said partition.

The pivoting suction orifice may be fixed to the turret by screwing.

According to one aspect of the disclosure, the propulsion and suction system is a unit consisting of propulsion motor and electrohydraulic water-jet pump.

The fundamental concepts of the disclosure having just been disclosed above in the most elementary form thereof, other details and features will emerge more clearly from a reading of the following description and with regard to the accompanying drawings, given by way of non-limitative example aspects of a robot for cleaning swimming pools in accordance with the principles of the disclosure.

BRIEF DESCRIPTION OF THE DRAWINGS

The figures and the elements in any one figure are not necessarily to the same scale. In all the figures, identical elements bear the same numerical reference.

There are thus illustrated in.

DETAILED DESCRIPTION

The terminology used in the present description must under no circumstances be interpreted in a limitative or restrictive way. It is simply used in conjunction with a detailed description of certain aspects of the disclosure.

In the aspect of the disclosure described below, reference is made to an autonomous robot intended mainly for cleaning swimming pools. This example, which is non-limitative, is given for a better understanding of the disclosure and does not exclude the adaptation of the disclosure to any cleaning robot for surfaces immersed in a liquid or to a suction head equipping another appliance such as a power sweeper for example.

In the remainder of the description, the term "robot" or the expression "swimming-pool robot" designate indifferently and by extension an autonomous robot for cleaning swimming pools.

Figure 1:
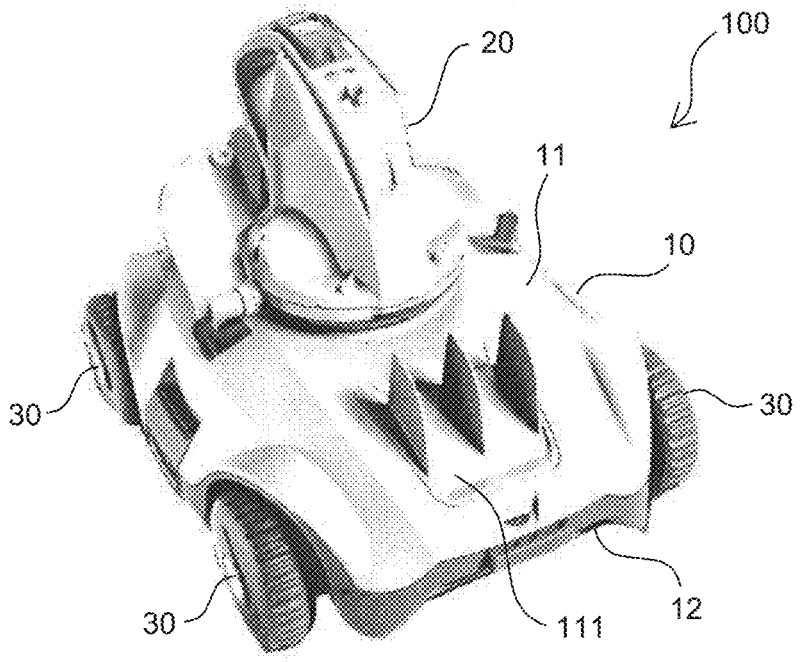
FIG. 1: a perspective view of a swimming-pool robot according to the disclosure.
Figure 2:
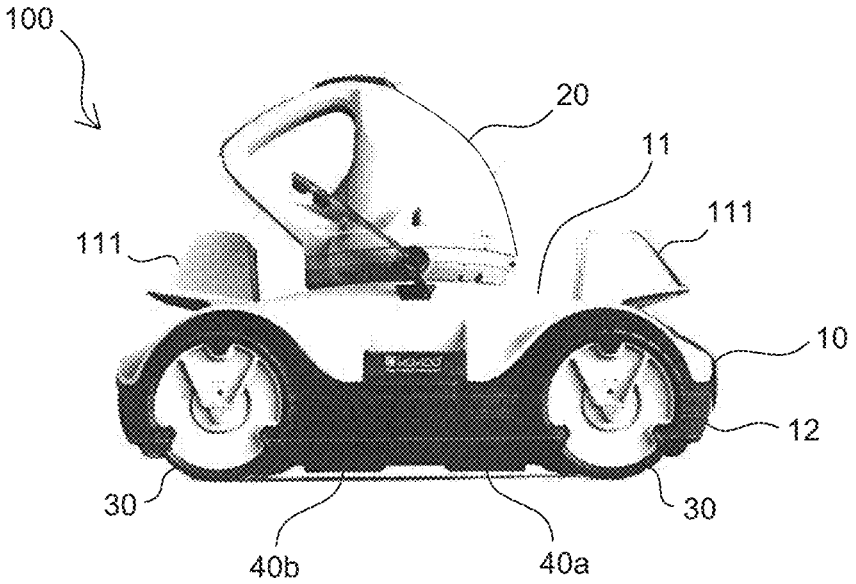
FIG. 2: a side view of the robot of FIG. 1.

FIGS. 1 and 2 show a robot 100 according to the disclosure comprising mainly a body 10, formed by assembling a top shell 11 and a bottom shell 12, a watertight turret 20, containing a unit consisting of propulsion motor and electrohydraulic pump and its electrical supply battery, none shown, wheels 30 and water inlets 40*a* and 40*b* provided in the bottom of the body 10.

The body 10 may have any form and dimensions in order to adapt to the various sizes of pools, preferably a substantially compact form and small dimensions for a practical and discreet appearance. According to the example aspect of the disclosure illustrated, the body 10 consists of two parts that can be fitted together, the top shell 11 and the bottom shell 12, thus facilitating dismantling of the body 10 for access to the internal space of said body. The internal space of the body 10, visible in FIG. 3, for its part contains a debris-collection device in the form of a filter 13 placed above a container embodied by a bottom part of said body, for example the bottom shell 12.

Figure 3:
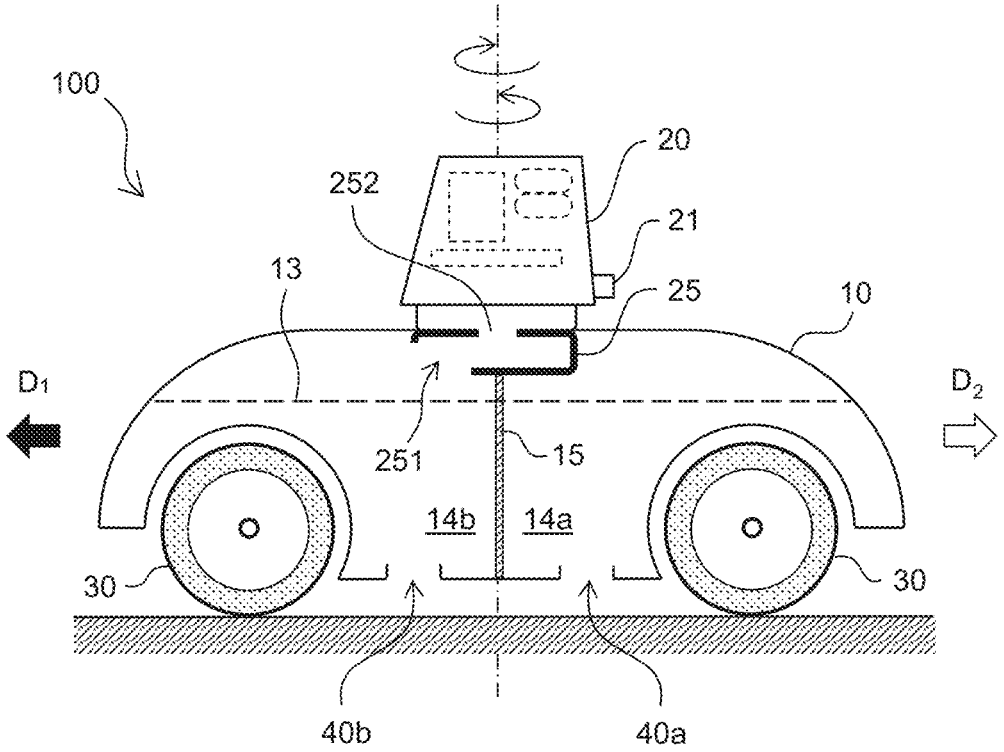
FIG. 3: a schematic side view of the robot revealing internal elements of the robot.

The turret 20 surmounts the body 10 and contains mainly the unit consisting of propulsion motor and electrohydraulic water-jet pump and the electrical supply battery, shown in broken lines in FIG. 3. The turret 20 is mounted on the body 10 by a rotary connection, implemented here by an annular collar on the body around a hole receiving an annular base of the turret, and is oriented in the direction of movement of the robot 100 in accordance with the principle described in the patent EP 3283711 B1.

The term "turret" is used here in its general acceptance of rotary device placed on a vehicle in order to orient a member and optionally to protect it.

The propulsion motor/pump unit comprises an electric motor, reduction gears and a turbine, the function of which is to aspirate the water, which enters through the water inlets 40*a* and 40*b* and passes through the filtering 13, and to discharge it through an ejection nozzle 21 that emerges from the turret in order to propel the robot 100, the direction of discharge being substantially parallel to the bottom of the swimming pool so as to favour propulsion.

Alternatively, the robot 100 may, instead of or in addition to the wheels 30, comprise other drive means such as rollers or tracks.

According to a fundamental aspect of the disclosure and with reference to FIG. 3, the robot 100 comprises a separation partition 15 in the body 10, dividing the internal space of the body into two isolated compartments 14*a* and 14*b*, and a pivoting suction orifice 25, integral with the rotary turret 20.

The partition 15 is disposed vertically on a transverse midplane of the body 10, thus dividing the body into two compartments with substantially equal volumes. Advantageously, the partition 15 has a small thickness, of a few millimetres, in order to limit the occupation of the useful debris-collection volume. The partition 15 has a top edge fitting flush with the pivoting suction orifice 25.

The pivoting suction orifice 25 is rotated by the turret 20 and comprises a lateral opening 251 and a top opening 252. The lateral opening 251 is placed on either side of the partition 15 depending on the orientation of the turret 20, and thereby of the pivoting orifice 25, so that the orifice communicates with one compartment 14*a* or 14*b* at a time, thus concentrating the suction at a single water inlet 40*a* or 40*b*. The top opening 252 for its part gives access to the ejection nozzle 21 of the robot.

The pivoting orifice 25 makes it possible both to allow passage of water through a compartment of the body 10 and to oppose the passage of water in the other compartment, and vice versa, thus imposing the circulation of water in a single direction, like a valve.

Figure 4:
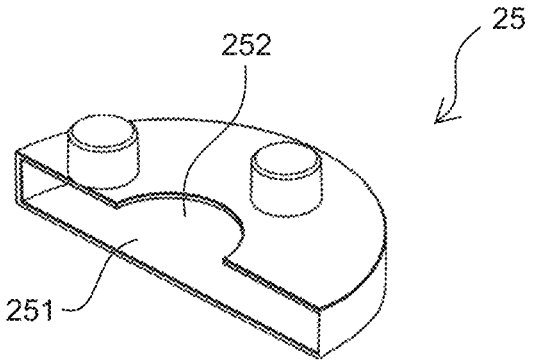
FIG. 4: a perspective view of a pivoting suction orifice according to the disclosure.

The lateral 251 and top 252 openings may be separated, as in the example in FIG. 3, or contiguous with a common edge, as in the example in FIG. 4, in which case their edges form a closed curve extending in the lateral and top faces of the pivoting orifice 25.

The pivoting orifice 25, according to the example aspect of the disclosure in FIG. 4, has the form of a semicylinder with a flattened hollow circular base, wherein the lateral opening 251 is rectangular and extends along a diameter of the base, and the top opening 252 is an axial hole in the form of a semicircle. Thus the pivoting orifice 25 defines a cavity with a circular lateral wall, advantageous for the circulation of water during suction while favouring the formation of vortices converging towards the top opening 252. The pivoting orifice 25 further comprises fixing means, not depicted, enabling it to be assembled with the turret 20. Such means are for example a thread produced on the lateral face of the pivoting orifice in order to screw said orifice into a suitable bore in the turret.

The pivoting orifice 25 according to the disclosure may have other forms provided that it allows the suction of water into a first compartment of the body while blocking it in the second, and this in an alternating fashion according to the rotation of the turret.

With reference to FIG. 3, the pivoting orifice 25 is oriented towards the front compartment 14*b*, the robot 100 moving in the direction D1 indicated by the solid arrow. Consequently, the suction is concentrated solely in the compartment 14*b*, the water enters through the front water inlet 40*b*, passes successively through the filter 13, the lateral opening 251 and the top opening 252 of the pivoting orifice 25, and finally emerges through the ejection nozzle 21, which is not depicted. In the rear compartment 14*a*, the suction is blocked by the pivoting orifice 25, which closes off the passage between said compartment and the partition 15.

Thus all the suction power is used at the water inlet 14*b* instead of being distributed over the two inlets as in the prior art. Because of this, the negative pressure, or suction force, obtained at the inlet 14*b* is greater because of the reduction in the suction cross section.

When the robot 100 changes direction of movement and starts again in the direction D2, the mechanism describes the reverse and the suction is concentrated in the compartment 14*a*, which becomes the front compartment of the robot.

Figure 5:
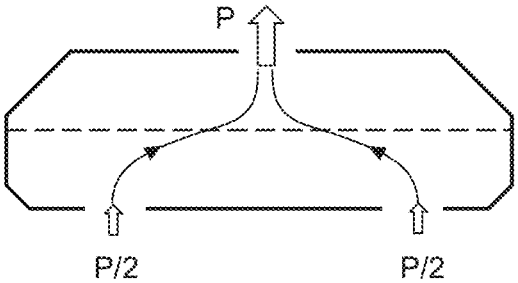
Fig. 5 PRIOR ART
FIG. 5: a schematic longitudinal section of a robot of the prior art.
Figure 6A:
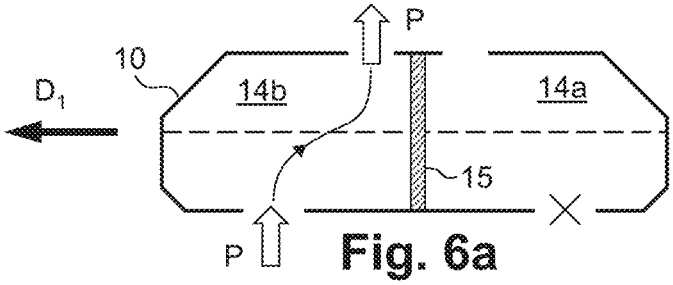
FIG. 6*a*: a schematic longitudinal section of the body of the robot according to the disclosure in a first direction of movement.
Figure 6B:
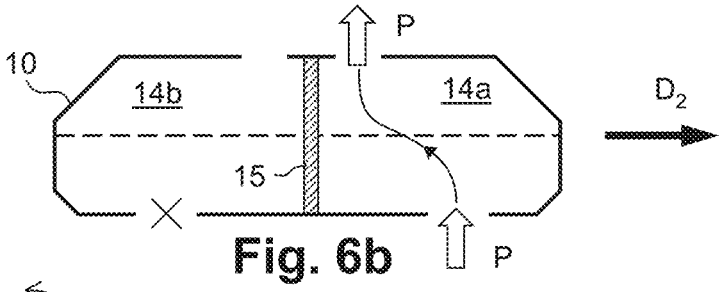
FIG. 6*b*: a schematic longitudinal section of the body of the robot in a second direction of movement, opposite to the one in FIG. 6*a;*

A comparison between FIG. 5, depicting the prior art, and FIGS. 6*a* and 6*b* depicting the present disclosure, makes it possible to understand the advantage procured by a concentration of the suction at a single water inlet, an alternating suction, compared with a distribution of the suction over two water inlets with alternating suction.

In the case of simultaneous suction, the useful power available P is shared between the two water inlets, which each suck with a useful power equal to P/2, to within a few losses.

In the case of alternating suction, the useful power available P is completely reserved for one water inlet at a time, the suction through the other inlet being blocked.

Figure 7:
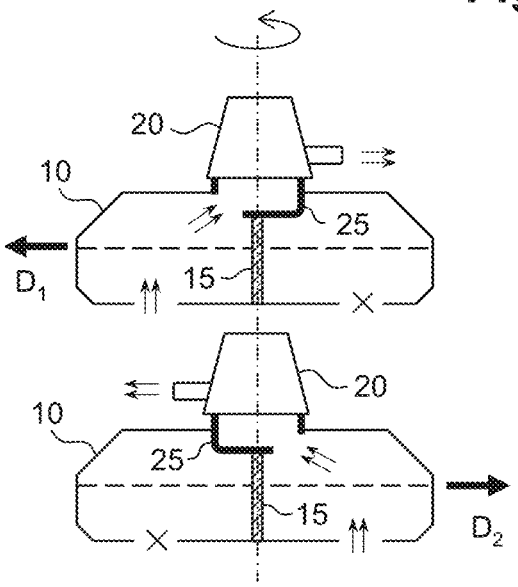
FIG. 7: a first aspect of the robot in FIGS. 6*a* and 6*b;*

FIG. 7 shows schematically an alternating suction performed by the turret 20 and the pivoting orifice 25 according to the aspect of the disclosure described below.

Figure 8:
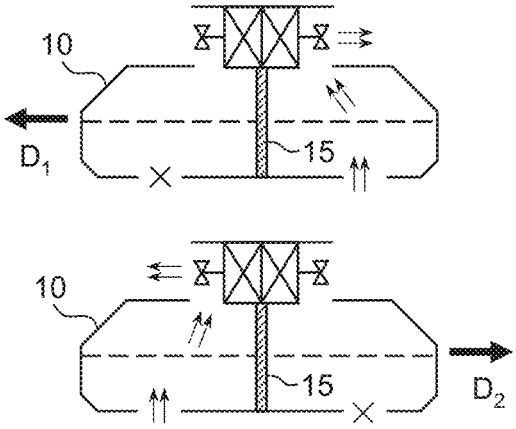
FIG. 8: a second aspect of the robot in FIGS. 6*a* and 6*b;*
Figure 9:
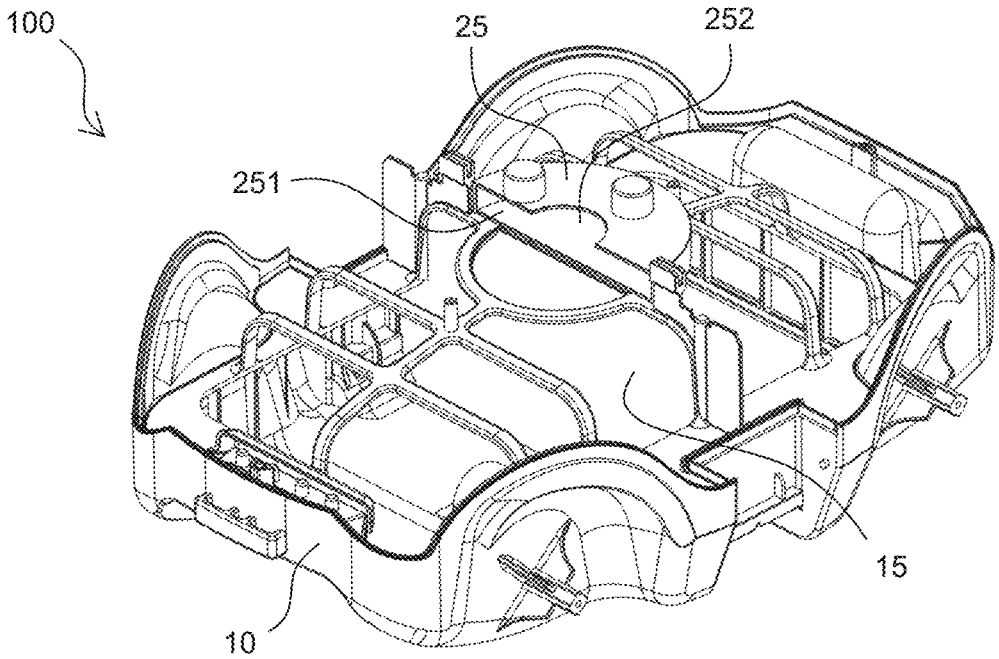
FIG. 9: a partial perspective view of the robot according to the disclosure.
Figure 10:
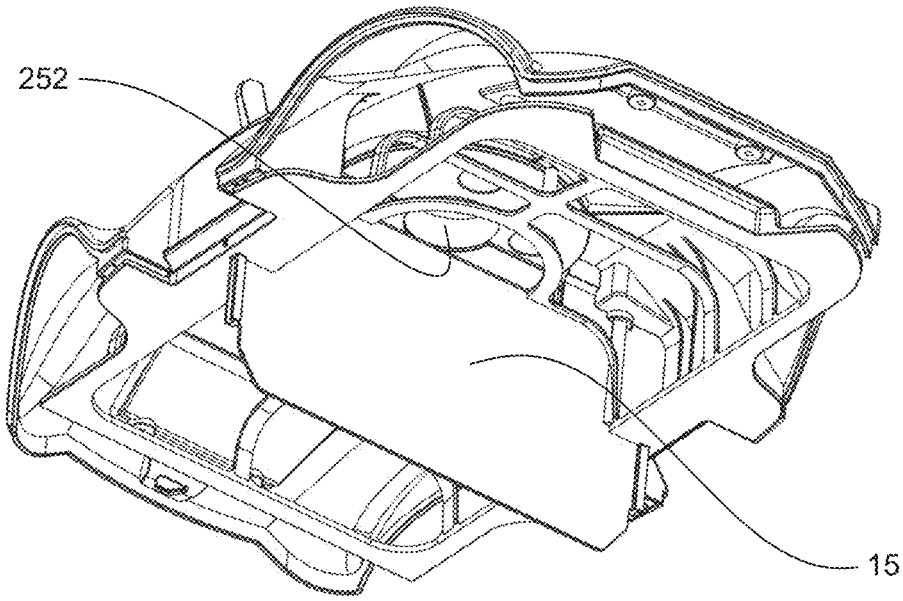
FIG. 10: another partial perspective view of the robot according to the disclosure.
Figure 11:
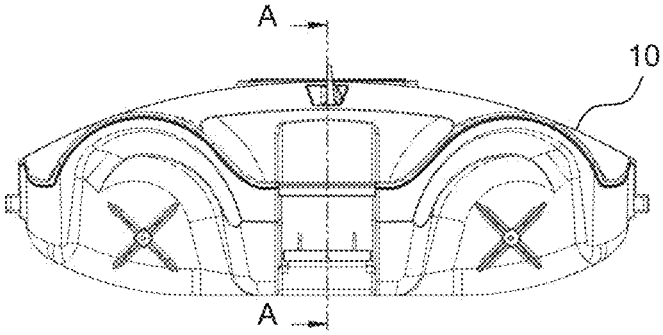
FIG. 11: a partial side view of the robot according to the disclosure.
Figure 12:
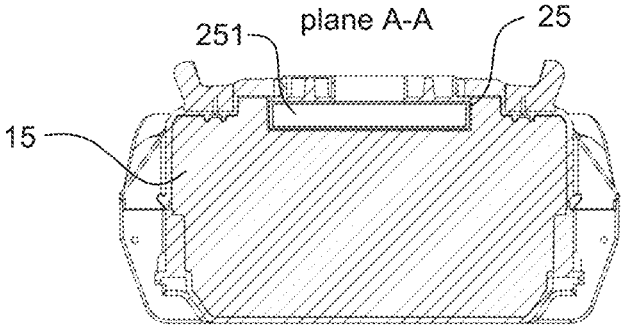
FIG. 12: a cross section of the robot in FIG. 11 along a transverse plane A-A.
Figure 13:
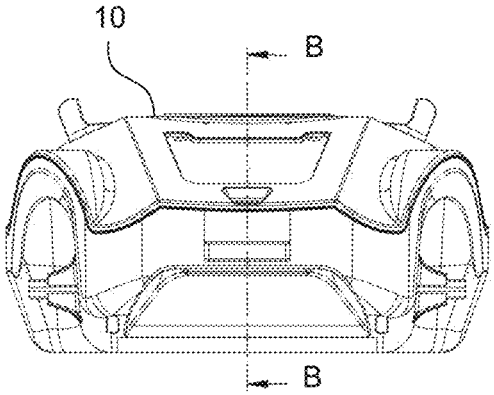
FIG. 13: a partial front view of the robot according to the disclosure.
Figure 14:
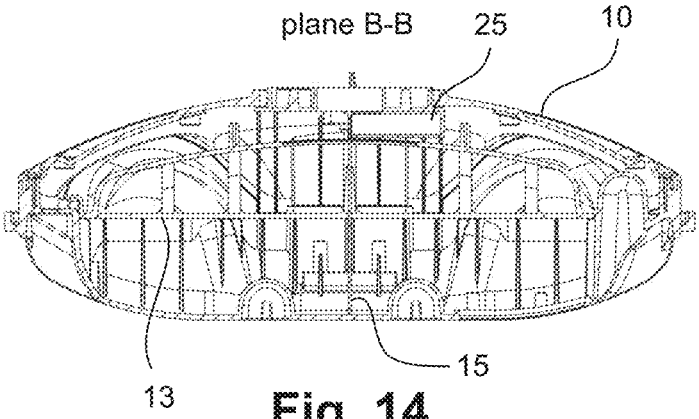
FIG. 14: a cross section of the robot in FIG. 13 along a longitudinal plane B-B.

Alternatively, FIG. 8 shows schematically an alternating suction obtained in a double-propeller robot for bidirectional propulsion, in which the body 10 is divided into two filtering compartments by a partition 15. According to this design, each suction/propulsion propeller is associated with a single filtering compartment, itself associated with a single suction orifice. Thus the presence of the separation partition 15 makes it possible to concentrate the total suction of the robot in one compartment or the other according to the direction of movement of said robot.

FIGS. 9 to 14 depict the separation partition 15 and the pivoting suction orifice 25 installed in a real swimming pool robot such as the one in FIGS. 1 and 2.

Having regard to the disclosure, it is clear that minor modifications can be applied to the robot, and particularly to the separation partition and/or to the pivoting suction orifice, without departing from the scope of the disclosure, the main object of which is alternating suction.

What is claimed is:

1. A robot for cleaning swimming pools, comprising a debris-collection body and a propulsion and suction system able to move the robot in alternation in two substantially opposite directions, wherein the body comprises two filtering compartments separated by a partition and each provided with a water inlet, said partition making it possible to concentrate the total suction of the robot in one compartment and to block it in the other according to the direction of movement of the robot.

2. The robot according to claim 1, wherein the propulsion and suction system is contained in a waterproof rotary turret external to the body of the robot and wherein each direction of movement of the robot is determined by an automatic orientation of the turret.

3. The robot according to claim 1, wherein the propulsion and suction system comprises two motorised propellers, each of said propellers providing the propulsion of the robot in one of the movement directions and the suction in one of the filtering compartments.

4. The robot according to claim 2, comprising a pivoting suction orifice integral with the turret, said orifice allowing the passage of water in one compartment and blocking the passage of water in the other compartment, so as to concentrate the total suction of the robot in one compartment or the other according to the direction of movement of the robot.

5. The robot according to claim 4, wherein the pivoting suction orifice comprises a lateral opening, communicating with one compartment at a time, and a top opening communicating with a water outlet of the robot.

6. The robot according to claim 5, wherein the pivoting suction orifice is in the form of a hollow cylinder with a circular base, the lateral opening being produced on a diameter of said cylinder and the top opening being axial and contiguous with said lateral opening.

7. The robot according to claim 4, wherein the pivoting suction orifice is disposed above the partition so as to fit flush with a top edge of said partition.

8. The robot according to claim 4, wherein the pivoting suction orifice is fixed to the turret by screwing.

9. The robot according to claim 1, wherein the propulsion and suction system is a unit consisting of propulsion motor and electrohydraulic water-jet pump.

10. The robot according to claim 1, further comprising an on-board power-supply battery.

* * * * *